US005620351A

United States Patent [19]

Ho

[11] Patent Number: 5,620,351

[45] Date of Patent: Apr. 15, 1997

[54] BUBBLE TOY

[75] Inventor: Yat-Ming Ho, New Territories, Hong Kong

[73] Assignee: Well Skill Industrial Ltd., Hong Kong, Hong Kong

[21] Appl. No.: 384,228

[22] Filed: Feb. 6, 1995

Related U.S. Application Data

[63] Continuation of Ser. No. 154,004, Nov. 18, 1993, abandoned.

[51] Int. Cl.[6] ..... A63H 33/28; A63H 27/00

[52] U.S. Cl. ..... 446/15; 446/61; 473/326

[58] Field of Search ..... 273/167 E, 167 F, 273/171, 170; 446/15, 16, 17, 18, 19, 20, 21, 34, 36, 46, 48, 61

[56] References Cited

U.S. PATENT DOCUMENTS

| | | | |
|---|---|---|---|
| 1,133,129 | 3/1915 | Govan | 273/171 |
| 1,205,123 | 11/1916 | Bradway | 446/19 |
| 3,002,314 | 10/1961 | Brottman | 446/15 |
| 3,855,728 | 12/1974 | Hynds | 446/46 |
| 4,184,284 | 1/1980 | Rogahn | 446/48 X |
| 4,541,631 | 9/1985 | Sasse | 273/170 |
| 4,940,441 | 7/1990 | Novinsky | 446/48 X |
| 4,982,959 | 1/1991 | Rudell et al. | 446/475 X |
| 5,078,636 | 1/1992 | Clark et al. | 446/20 X |
| 5,088,950 | 2/1992 | LaFata | 446/19 |
| 5,102,381 | 4/1992 | Danielak et al. | 446/15 X |
| 5,224,893 | 7/1993 | Routzong et al. | 446/15 |
| 5,269,715 | 12/1993 | Silveria et al. | 446/16 |
| 5,393,256 | 2/1995 | Mitchell et al. | 446/48 X |

FOREIGN PATENT DOCUMENTS

| | | | |
|---|---|---|---|
| 2040532 | 2/1972 | Germany | 446/15 |
| 116013 | 5/1918 | United Kingdom | 446/20 |

*Primary Examiner*—Robert A. Hafer
*Assistant Examiner*—D. Neal Muir
*Attorney, Agent, or Firm*—Burns, Doane, Swecker & Mathis

[57] ABSTRACT

The invention relates to a toy, for example a Frisbee-type disc, a toy aircraft, a toy club or a toy baton, provided with means for generating a stream of bubbles in use. The toy is constructed with a liquid reservoir which feeds liquid through a narrow gap to holes formed in overlying superimposed planar members. At these holes the liquid, which is a bubble-forming liquid such as a soap solution, forms a thin film until a bubble is formed under the influence of the airstreams generated around the holes as the toy moves in the air.

7 Claims, 4 Drawing Sheets

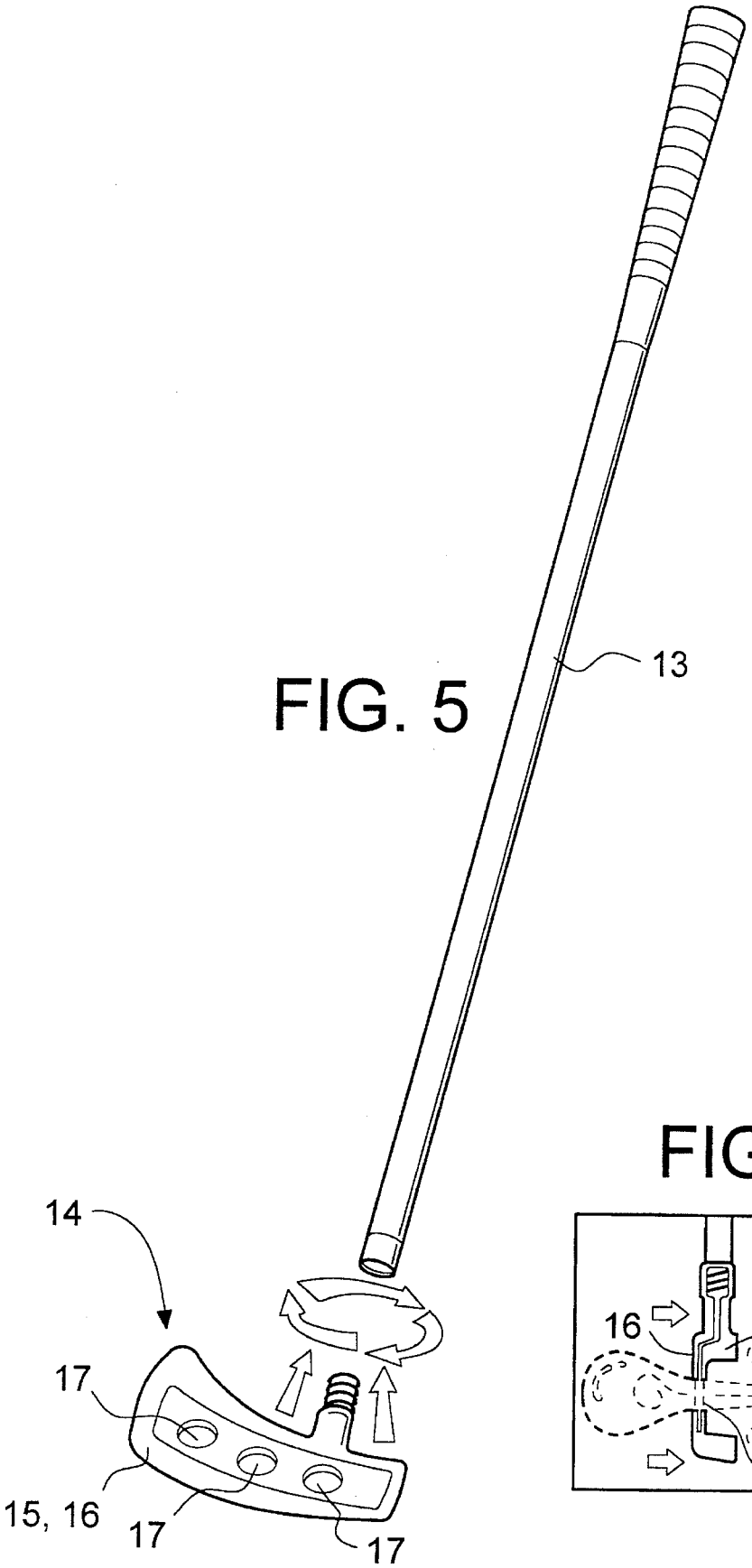
FIG. 5
FIG. 6
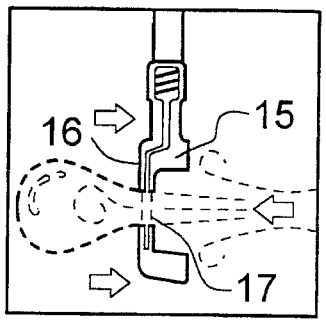

BUBBLE TOY

This application is a continuation of application Ser. No. 08/154,004, filed Nov. 18, 1993 abandoned.

FIELD OF THE INVENTION

This invention relates to a toy, for example a toy aircraft, a flying disc, a toy baton, or a toy golf club, having the ability to generate bubbles in use.

BACKGROUND OF THE INVENTION

Many different types of toys are known. For example there are toy aircraft that can actually fly and which may be powered, propelled by a catapult system or simply thrown by a user. Another type of flying toy is a flying disc, as exemplified by the very well known Frisbee (RTM), which is thrown by a player with a spinning action and can form part of a catching game. Such types of flying toys have provided much pleasure and amusement in the past, but it is an object of the present invention to provide a development of such toys to add an extra feature so that a child (or adult) playing with the toy can derive additional pleasure and amusement. Also known are many other types of toys including toy batons, toy golf clubs or the like, and again it is an object of the present invention to provide such toys with an additional degree of enjoyment in their use.

SUMMARY OF THE INVENTION

It is a particular object of the invention to provide a toy which is capable of producing a stream of bubbles in the air while in use. Accordingly the present invention provides a toy comprising, a liquid reservoir and two members, each of said planar members having a plurality of holes therein and said members being so disposed that the holes in one of said members overlay corresponding holes in the other of said members, a gap being defined between said members communicating said holes with said reservoir.

With such an arrangement the reservoir can be filled in advance with a bubble-forming liquid, for example a soap solution or the like, and when the toy is in use this liquid will leak from the reservoir to the holes by means of the gap. When the liquid reaches the holes it forms a thin film thereacross, which in turn forms a bubble under the action of airstreams around the hole caused by movement of the toy in use. The toy may take one of several different forms, for example it may be in the form of a flying disc, or alternatively it may comprise a toy aircraft, whereby when in flight the bubbles are generated, or it may comprise a toy such as a toy baton or a toy golf club whereby bubbles are generated when the toy is swung in play.

According to the present invention there is provided a flying disc comprising, a liquid reservoir, two members adjacent said liquid reservoir and having a plurality of holes therein, said members being so disposed that the holes in one of said members overlay corresponding holes in the other of said members, a gap being defined between said members communicating said holes with said liquid reservoir.

Preferably the reservoir is centrally located and the two members are annular members surrounding the reservoir. However the reverse arrangement may also be possible with the reservoir surrounding the bubble generating members.

According to the present invention there is further provided a toy aircraft, comprising a fuselage section and wings extending on opposed sides of said fuselage section, said fuselage section including a liquid reservoir and said wings each comprising a pair of superimposed members having a plurality of holes therein, said members in each said wing being so disposed that the holes in one of said members overlay corresponding holes in the other of said members, and a gap being defined between the members in each said wing communicating said holes with said liquid reservoir.

According to the present invention there is further provided a toy golf club wherein the club head comprises two spaced apart members, each of said members having at least one opening therein and the opening(s) in said members overlaying each other, a liquid reservoir being provided in a shaft of the golf club and communicating with the space between said members.

According to a still further aspect of the invention there is provided a toy baton comprising a shaft member and a head, said head comprising two coaxial cylindrical members having a space defined therebetween, said cylindrical members being provided with apertures and being arranged such that the apertures in one said member overlay the apertures in the other said member, and said shaft member including a liquid reservoir in communication with the space defined between said cylindrical members.

BRIEF DESCRIPTION OF THE DRAWINGS

Several embodiments of the invention will now be described by way of example and with reference to the accompanying drawings, in which:

FIG. 5 is a perspective view of a third embodiment in the form of a toy golf club, FIG. 6 is a sectional detail through the head of the golf club of FIG. 5.

DETAILED DESCRIPTION OF PREFERRED EMBODIMENTS

Figure 1:
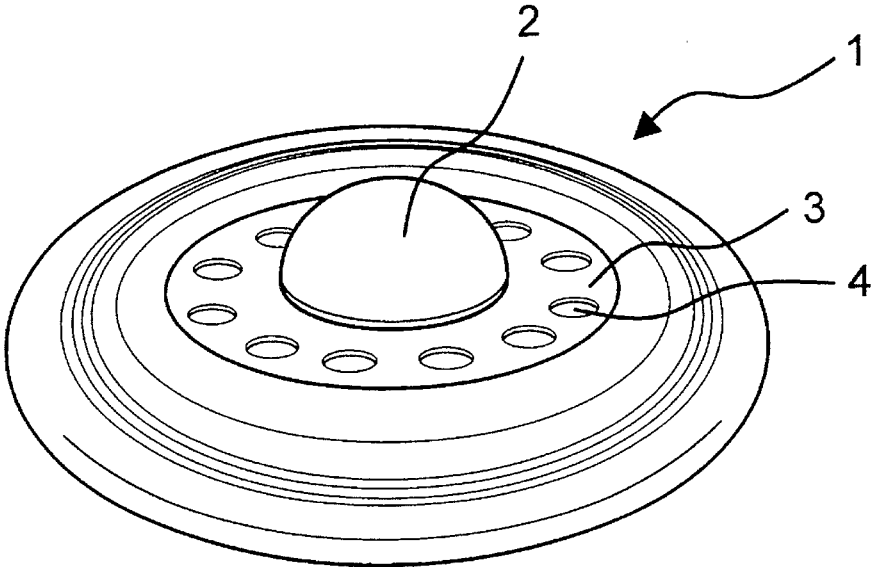
FIG. 1 is a perspective view showing a first embodiment of the invention in the form of a flying disc.

Referring firstly to FIG. 1 there is shown a first embodiment in the form of a flying disc 1 of the well-known Frisbee (RTM) type. At the centre of the disc 1 is provided a dome-like liquid reservoir 2 which may be filled with liquid through an opening (not shown) in the base of the disc 1. Surrounding the reservoir 2 are two superimposed planar annular members 3 having a plurality of holes 4 disposed circumferentially about the reservoir 2. The holes in the planar members are disposed so as to coincide and overlay each other. The two planar members 3 are arranged to have a narrow gap 5 between them the purpose of which will be described further below.

Figure 2:
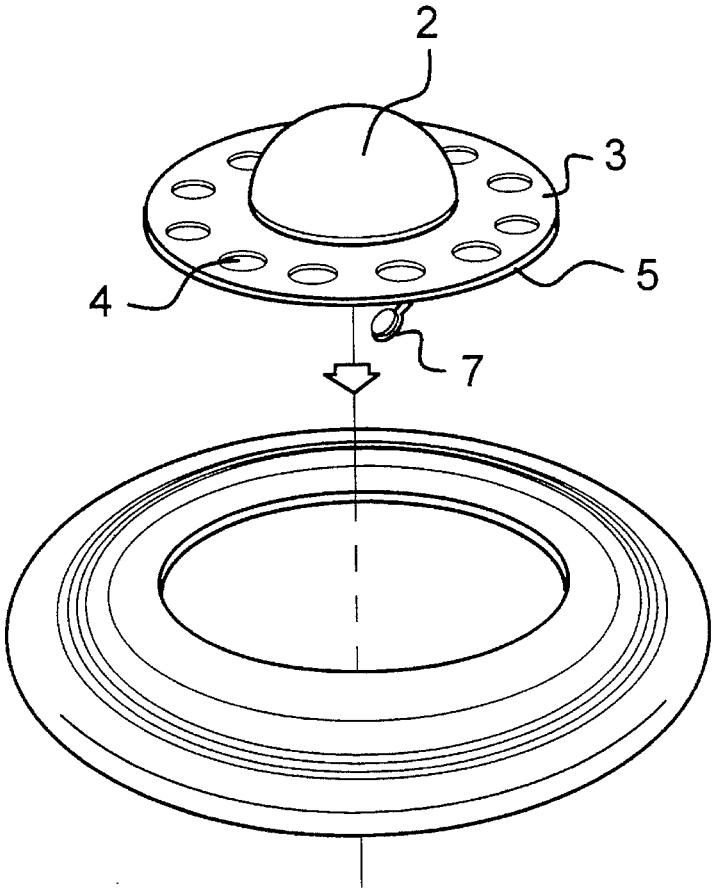
FIG. 2 is a perspective view similar to FIG. 1 but showing parts disassembled.

As can be seen from FIG. 2 the reservoir and the surrounding planar members may be formed as a seperate sub-assembly from the remainder of the disc, the remainder of the disc corresponding to a conventional Frisbee-type disc with a hole in the centre thereof for location of the reservoir sub-assembly. The hole must be larger than the diameter of the circumferential array of holes 4 to ensure that the holes are open to air both above and below the disc.

Figure 3:
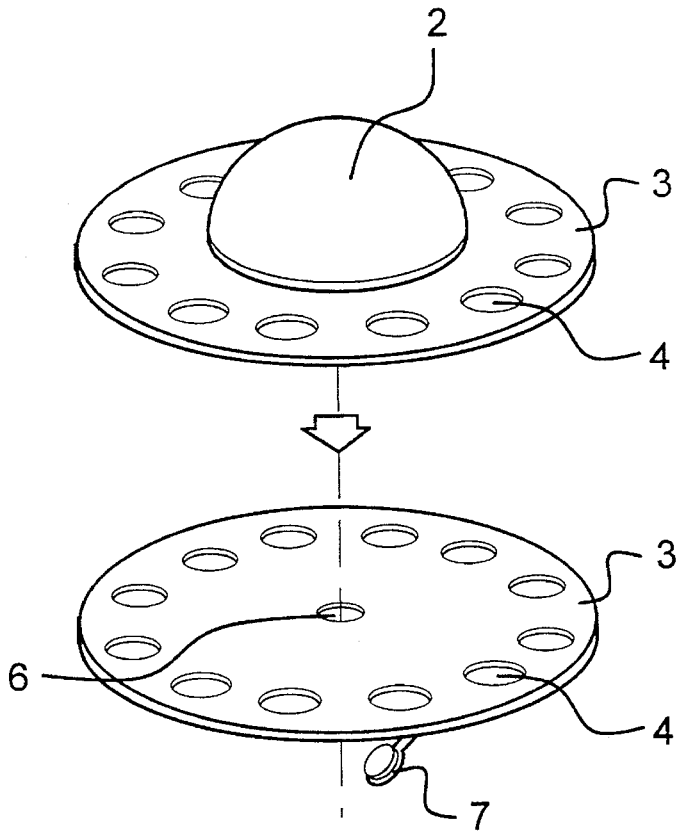
FIG. 3 is a perspective view showing the reservoir and annular planar members of the embodiment of FIG. 1.

Referring to FIG. 3 it will be seen that the reservoir sub-assembly may comprise two parts: a first part including the dome-like reservoir 2 integrally formed with a surrounding annular planar member 3, and a second part in the form of a disc comprising the second annular planar member and a central hole 6 for filling the reservoir and a cap 7 for closing the filling hole 6. As previously discussed the two planar members 3 are provided with substantially identical circumferential arrays of holes so that when assembled each hole in one of the two planar members is in a corresponding location to one of the holes in the other planar member. The two planar members are secured together about their rims by any suitable and convenient manner.

The operation of the toy flying disc as shown in FIGS. 1 to 3 will now be described. The liquid reservoir is filled with a bubble-producing liquid such as, for example, a soap solution through the filling opening and then the reservoir is closed by the filling cap. The disc is then thrown with a conventional spinning Frisbee action. Because of the gap between the two planar members, which communicates the reservoir with the holes, liquid leaks from the reservoir outwardly and this natural leakage is encouraged by the centrifugal effect of the spinning disc. When the liquid reaches a hole 4 it forms a thin film thereacross and under the influence of airstreams above and below the disc forms into a bubble which will break away from the spinning disc. This process will be repeated again and again at each hole until the liquid reservoir is emptied or the disc comes to rest.

Figure 4:
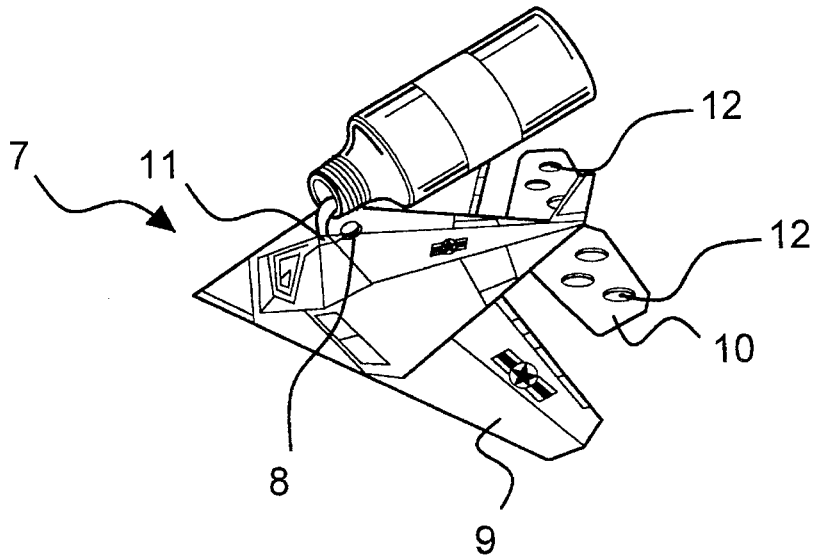
FIG. 4 is a perspective view of a second embodiment, in the form of a toy aircraft, in use.

FIG. 4 illustrates a second embodiment of the invention in which the toy is in the form of a toy aircraft 7. The toy aircraft 7 includes a main fuselage section 8, main wings 9 and tailplane wings 10. The interior of the main fuselage section 8 is hollow and comprises a liquid reservoir which may be filled through filling opening 11 which in turn may be closed by filling cap 12. The two tailplane wings 10, one on either side of the fuselage at the end thereof, are each formed of two superimposed planar members 11 which in turn are each formed with a plurality of holes 12 therein. The holes 12 in each planar member are superimposed as in the first embodiment. Also as in the first embodiment a narrow gap is defined between the planar members in each tailplane wing 10, which gap communicates with the liquid reservoir defined by the fuselage section. In use the toy aircraft may be propelled by a catapult (not shown). After being launched the liquid in the reservoir, which may be a bubble-forming liquid such as a soap solution, leaks from the reservoir through the gap defined between the planar members to the holes 12 where it forms a thin film. As in the first embodiment the action of the airstreams above and below the tailplane wings 10 cause bubbles to be formed at the holes which then break away from the aircraft to form a continuous stream of bubbles behind the aircraft.

Alternatively, instead of forming the holes in the tailplane wings, they could instead be formed in the main lift generating wings, or alternatively the tail of the aircraft could be formed of the requisite two planar member structure with holes communicating with the reservoir by means of a gap between the members.

FIGS. 5 and 6 show a third embodiment of the invention in the form of a toy golf club. The toy club includes a handle and shaft 13 in which is received a liquid reservoir (not shown) for receiving a bubble generating liquid. The "head" 14 of the golf club comprises two members 15, 16 spaced apart by a small distance. Each member 15, 16 includes three holes 17, the holes in one member 15 overlying the corresponding holes in the other member 16. The head 14 is screwed to the base of the shaft 13 and the liquid reservoir is in communication with the gap defined between the spaced apart members 15, 16. In use liquid flows from the reservoir into the gap where it forms a thin film across the holes, and movement of the club head through the air as the club is swung causes bubbles to be generated at the holes as shown in FIG. 6. The reservoir may be refilled by unscrewing the club head and pouring liquid into the shaft member.

Figure 7:
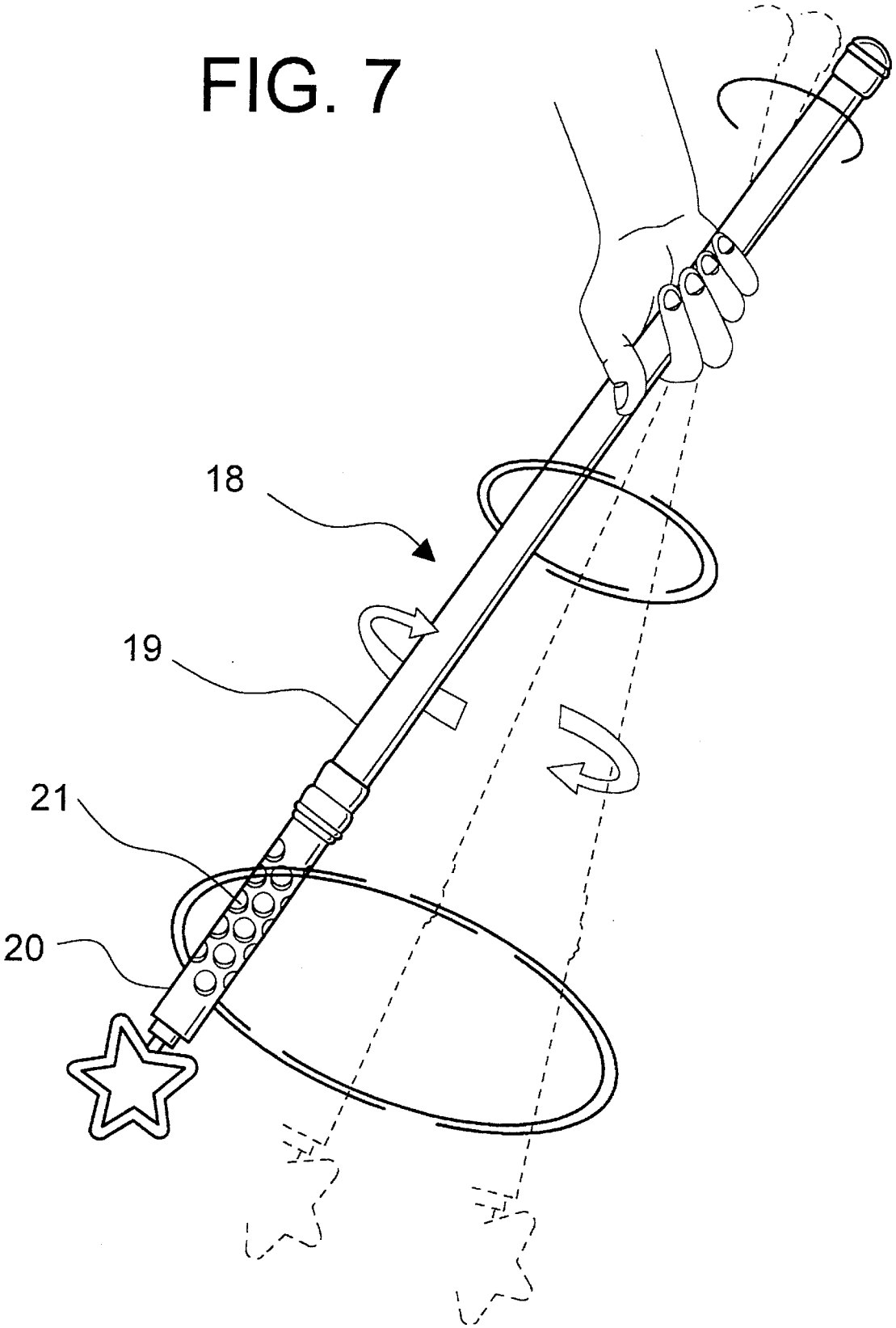
FIG. 7 is a perspective view of a fourth embodiment in the form of a toy baton.

FIG. 7 shows a fourth embodiment in the form of a toy baton. The baton 18 includes a handle or shaft member 19 in which is received a liquid reservoir. At the end of the shaft member are provided two coaxial cylindrical members 20 each having a plurality of apertures 21 therein, the apertures in one member being positioned so as to coincide with the apertures of the other. Between the two coaxial cylindrical members is defined a small gap which is in communication with the liquid reservoir. In use, as the toy baton is swung, liquid flows from the reservoir to the gap between the two coaxial cylindrical members where it forms a thin film across the gap and a bubble is subsequently generated as the baton moves through the air.

I claim:

1. A toy aircraft comprising a fuselage and a pair of wings extending from opposed sides of said fuselage, each of said wings being formed by two substantially planar members that are oriented in a direction generally parallel to the intended direction of flight of the toy aircraft, each of said members having a plurality of holes therein and said members being so disposed that the holes in one of said members overlay corresponding holes in the other of said members, with a gap defined between said members, and said fuselage defining a liquid reservoir adapted to supply liquid continuously to the gap defined between the members in a direction substantially parallel to the surface of said members.

2. A toy aircraft as claimed in claim 1 wherein said planar members comprise tailplane wings.

3. A toy aircraft as claimed in claim 1 wherein said planar members comprise main aircraft wings.

4. A toy aircraft comprising a fuselage section and wings extending on opposed sides of said fuselage section, said fuselage section including a liquid reservoir and said wings each comprising a pair of superimposed members having a plurality of holes therein, said members in each said wing being so disposed that the holes in one of said members overlay corresponding holes in the other of said members, and a gap being defined between the members in each said wing communicating with said liquid reservoir.

5. A toy aircraft comprising, a liquid reservoir and two members, each of said members having a plurality of holes therein and said members being so disposed that the holes in one of said members overlay corresponding holes in the other of said members, a gap being defined between said members communicating said holes with said reservoir, wherein said toy aircraft comprises a fuselage and a pair of wings extending from opposed sides of said fuselage, said fuselage comprising said liquid reservoir and said wings being formed of said planar members with said holes formed therein.

6. A toy aircraft as claimed in claim 5 wherein said planar members comprise tailplane wings.

7. A toy aircraft as claimed in claim 5 wherein said planar members comprise main aircraft wings.

* * * * *